US008006942B2

(12) United States Patent
Mathews, Jr. et al.

(10) Patent No.: US 8,006,942 B2
(45) Date of Patent: Aug. 30, 2011

(54) HOT RAIL WHEEL BEARING DETECTION

(75) Inventors: Harry Kirk Mathews, Jr., Clifton Park, NY (US); John Erik Hershey, Ballston Lake, NY (US); Pierino Gianni Bonanni, Loudonville, NY (US); Benjamin Paul Church, Blue Springs, MO (US); Brock Estel Osborn, Niskayuna, NY (US)

(73) Assignee: Progress Rail Services Corp, Albertville, AL (US)

( * ) Notice: Subject to any disclaimer, the term of this patent is extended or adjusted under 35 U.S.C. 154(b) by 167 days.

(21) Appl. No.: 12/122,539

(22) Filed: May 16, 2008

(65) Prior Publication Data

US 2008/0283679 A1 Nov. 20, 2008

Related U.S. Application Data

(60) Provisional application No. 60/938,475, filed on May 17, 2007.

(51) Int. Cl.
*B61K 9/00* (2006.01)

(52) U.S. Cl. ..... 246/169 A; 246/169 R; 246/169 D

(58) Field of Classification Search ..... 246/167 R, 246/169 A, 169 D; 250/339.04, 339.05; 340/682; 702/134, 135, 136, 40
See application file for complete search history.

(56) References Cited

U.S. PATENT DOCUMENTS

| | | | | |
|---|---|---|---|---|
| 3,731,087 | A | 5/1973 | King | |
| 4,313,583 | A * | 2/1982 | Bambara et al. | 246/169 A |
| 5,201,483 | A | 4/1993 | Sutnar et al. | |
| 5,331,311 | A | 7/1994 | Doctor | |
| 5,381,700 | A | 1/1995 | Grosskopf, Jr. | |
| 5,448,072 | A | 9/1995 | Gallagher | |
| 5,677,533 | A | 10/1997 | Yaktine et al. | |
| 6,911,914 | B2 * | 6/2005 | Mathews et al. | 340/682 |
| 2006/0131464 | A1 * | 6/2006 | Hesser et al. | 246/169 D |

* cited by examiner

*Primary Examiner* — Mark T Le
(74) *Attorney, Agent, or Firm* — Finnegan, Henderson, Farabow, Garrett & Dunner LLP

(57) ABSTRACT

A system for detecting a moving hot bearing or wheel of a rail car is provided. The system includes a first comparator to receive input signals representative of radiation emitted by the moving hot rail car bearing or wheel, and to compare the input signals to a threshold value. The system further includes a counter for counting incidents of the input signals exceeding the threshold value and a second comparator to compare a number of incidents of the input signals exceeding the threshold value to a count threshold as an indication of detection of a hot rail car bearing or wheel.

16 Claims, 3 Drawing Sheets

HOT RAIL WHEEL BEARING DETECTION

CROSS REFERENCE TO RELATED APPLICATIONS

This application is a non-provisional application of the provisional application Ser. No. 60/938,475, filed May 17, 2007, which is herein incorporated by reference.

BACKGROUND

The present invention relates generally to detection of abnormally hot rail car wheel bearing surfaces, and more specifically to signal processing of infrared signals emitted by hot surfaces of such bearings and surrounding structures.

Railcars riding on wheel trucks occasionally develop overheated bearings. The overheated bearings may eventually fail and cause costly disruption to rail service. Many railroads have installed wayside hot bearing detectors (HBDs) that view the bearings and surrounding structure surfaces as a rail car passes, and generate an alarm upon detection of an abnormally hot surface. One of the commonly used techniques includes employing sensors in the HBDs that sense heat generated by the bearing surfaces. For example, pyroelectric sensors may be used that depend upon the piezoelectric effect. However, such sensors can be susceptible to noise due to mechanical motion of the railcars. Such noise may result from so-called microphonic artifacts, and can complicate the correct diagnosis of hot bearings, or even cause false positive readings. In general, false positive readings, although false, nevertheless require stopping a train to verify whether the detected bearing is, in fact, overheating, leading to costly time delays and schedule perturbations.

Accordingly, an improved system and method that would address the aforementioned issues is needed.

BRIEF DESCRIPTION OF THE INVENTION

In accordance with one exemplary embodiment of the present invention, a system for detecting a moving hot bearing or wheel of a rail car is provided. The system includes a first comparator for receiving input signals representative of radiation emitted by the moving hot rail car bearing or wheel and for comparing the input signals to a threshold value. The system further includes a counter for counting incidents of the input signals exceeding the threshold value and a second comparator for comparing a number of incidents of the input signals exceeding the threshold value to a count threshold as an indication of detection of a hot rail car bearing or wheel.

In accordance with another embodiment of the present invention, a system for detecting a moving hot bearing or wheel of a rail car is provided. The system includes sensors disposed adjacent to a rail for detecting a radiation emitted by the moving hot rail bearing or wheel and a first comparator to receive input signal from the sensors representative of radiation emitted by the moving hot rail car bearing or wheel, and to compare the input signals to a threshold value. The system further includes a counter for counting incidents of the input signals exceeding the threshold value and a second comparator to compare a number of incidents of the input signals exceeding the threshold value to a count threshold as an indication of detection of a hot rail car bearing or wheel.

In accordance with yet another embodiment of the present invention, a system for detecting a moving hot bearing or wheel of a rail car is provided. The system includes sensors disposed adjacent to a rail for detecting the radiation emitted by the moving hot rail bearing or wheel and a first comparator to receive input signals from the sensors representative of radiation emitted by the moving hot rail car bearing or wheel, and to compare the input signals to a threshold value. The system further includes a rank filter to filter output of the comparator as an indication of detection of a hot rail car bearing or wheel.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
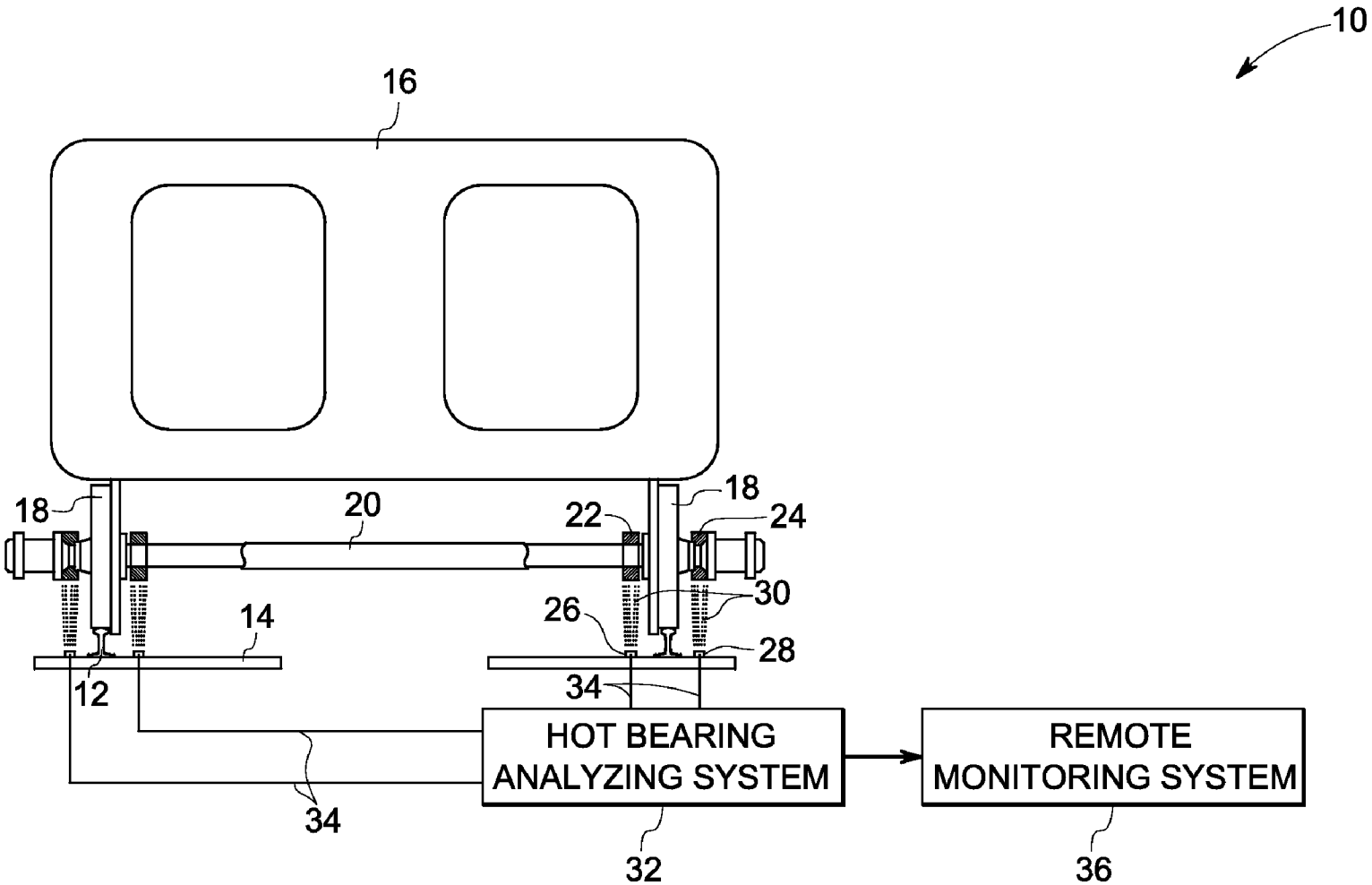
FIG. 1 is a diagrammatical representation of an exemplary system for detecting hot rail car bearings and wheel surfaces.

Referring now to the drawings, FIG. 1 illustrates an exemplary rail car bearing and wheel surface temperature detection system 10, shown disposed adjacent to a railroad rail 12 and a crosstie 14. A railway vehicle or car 16 includes multiple wheels 18, typically mounted in sets or trucks. An axle 20 connects wheels 18 on either side of the rail car. The wheels are mounted on and can freely rotate on the axle by virtue of bearings 22 and 24.

One or more sensors 26, 28 are disposed along a path of the railroad track to obtain data from the wheel bearings. As in the illustrated embodiment, an inner bearing sensor 26 and an outer bearing sensor 28 may be positioned in a rail bed on either side of the rail 12 adjacent to or on the cross tie 14 to receive infrared emission 30 from the bearings 22, 24. Examples of such sensors include, but are not limited to, infrared sensors, such as those that use pyrometer sensors to process signals. In general, such sensors detect radiation emitted by the bearings and/or wheels, which is indicative of the temperature of the bearings and/or wheels. In certain situations, the detected signals may require special filtering to adequately distinguish signals indicative of overheating of bearings from noise, such as microphonic noise. Such techniques are described below.

A wheel sensor (not shown) may be located inside or outside of rail 12 to detect the presence of a railway vehicle 16 or wheel 18. The wheel sensor may provide a signal to circuitry that detects and processes the signals from the bearing sensors, so as to initiate processing by a hot bearing or wheel analyzing system 32. In the illustrated embodiment, the bearing sensor signals are transmitted to the hot bearing analyzing system 32 by cables 34, although wireless transmission may also be envisaged. From these signals, the analyzing system 32 filters the received signals as described below, and determines whether the bearing is abnormally hot, and generates an alarm signal to notify the train operators that a hot bearing has been detected and is in need of verification and/or servicing. The alarm signal may then be transmitted to an operator room (not shown) by a remote monitoring system 36. Such signals may be provided to the on-board operations personnel or to monitoring equipment entirely remote from the train, or both.

Figure 2:
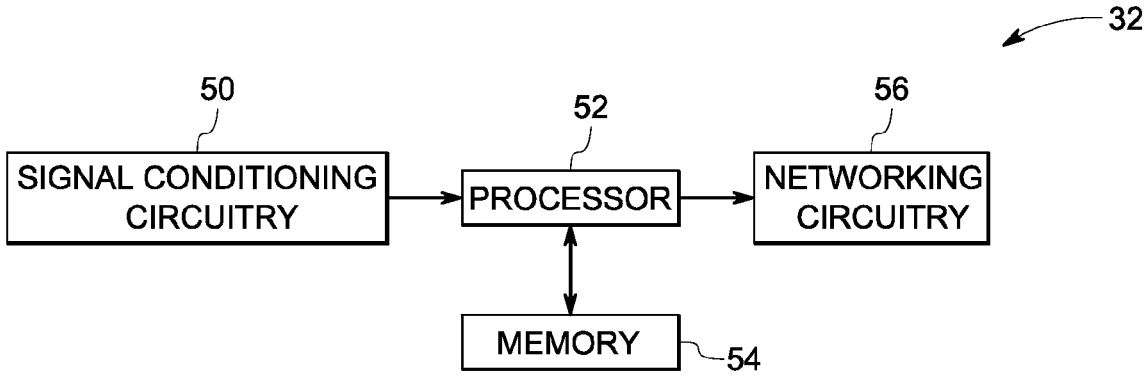
FIG. 2 is a diagrammatical representation of functional components of the hot bearing detection system of FIG. 1.

FIG. 2 is a diagrammatic representation of the functional components of the hot bearing analyzing system 32. The output of inner bearing sensor 26, outer bearing sensor 28 and the wheel sensor are processed via signal conditioning circuitry 50. Signal conditioning circuitry 50 may convert the sensor signals into digital signals, perform filtering of the signals, and the like. It should be noted that the circuitry used to detect and process the sensed signals, and to determine whether a bearing and/or wheel is hotter than desired, may be digital, analog, or a combination. Thus, where digital circuitry is used for processing, the conditioning circuitry will generally include analog-to-digital conversion, although analog processing components will generally not require such conversion.

Output signals from the signal conditioning circuitry are then transmitted to processing circuitry 52. The processing circuitry 52 may include digital components, such as a programmed microprocessor, field programmable gate array, application specific digital processor or the like, implementing routines as described below. It should be noted, however, that certain of the schemes outlined below are susceptible to analog implementation, and in such cases, circuitry 52 may include analog components. In one embodiment, the processor 52 includes a filter to eliminate noise from the electrical signal. In another embodiment, the processing circuitry 52 includes a peak detector for detecting a maximum value of the filtered signal and a comparator for comparing the maximum value of the filtered signal to a predefined threshold to produce an alarm signal.

The processing circuitry 52 may have an input port (not shown) that may accept commands or data required for presetting the processing circuitry. An example of such an input is a decision threshold (e.g., a value above which a processed signal is considered indicative of an overheated bearing and/or wheel). The particular value assigned to any of the thresholds discussed herein may be chosen readily by those skilled in the art using basic techniques of signal detection theory, including, for example, analysis of the sensor system "receiver operating characteristic". As an example, if the system places very high importance on minimizing missed detection (i.e., false negatives), the system may be set with lower thresholds so as to reduce the occurrence rate of missed detections to the maximum tolerable rate. On the other hand, the system thresholds may be set higher so as to reduce the rate of "false positives" while still achieving a desired detection rate, coinciding with maintaining an acceptable level of "false negatives". In general, and as described below, both types of false determinations may be reduced by the present processing schemes. As also described below, the system may implement an adaptive approach to setting of the thresholds, in which thresholds are set and reset over time to minimize occurrences of both false negative and false positive determinations.

When digital circuitry is used for processing, the processing circuitry will include or be provided with memory 54. In one embodiment processing circuitry 52 utilizes programming, and may operate in conjunction with analytically or experimentally derived radiation data stored in the memory 54. Moreover, memory 54 may store data for particular trains, including information for each passing vehicle, such as axle counts, and indications of bearings and/or wheels in the counts that appear to be near or over desired temperature limits. Processed information, such as information identifying an overheated bearing or other conditions of a sensed wheel bearing, may be transmitted via networking circuitry 56 to a remote monitoring system 36 for reporting and/or notifying system monitors and operators of degraded bearing conditions requiring servicing.

Figure 3:
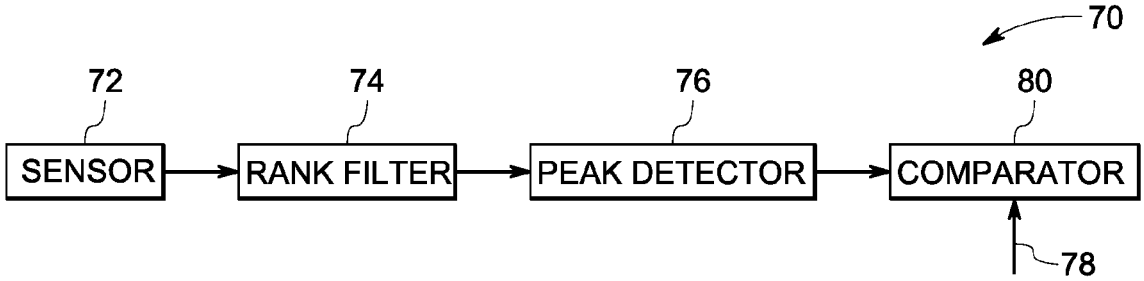
FIG. 3 is a diagrammatic representation of a rank filter for detecting hot rail car bearings and wheels.

FIG. 3 is a diagrammatical view of a hot rail car bearings and/or wheels detection system 70. The system 70 uses a rank filter 74 for filtering noise from the input signal. In FIG. 3, the rank filter 74 filters output of a sensor 72. The filtered output is then transmitted to a peak detector 76. The peak detector detects peak value from the filter output. The output of the peak detector 76 is then compared to a decision threshold 78 by a comparator 80. The rank filter 74 involves a sorting operation, which is computationally intensive. In an alternative embodiment of the present invention, also described herein, a computationally easy implementation of hot rail car bearing and/or wheels detection system is provided.

Figure 4:
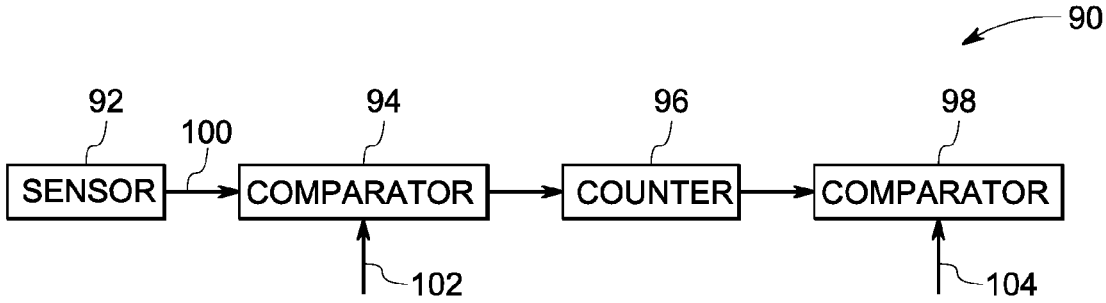
FIG. 4 is a diagrammatic representation of comparator-counter-comparator system for detecting hot rail car bearings and wheels, in accordance with an embodiment of the present invention.

FIG. 4 is a comparator-counter-comparator embodiment 90 of processing circuitry for detecting hot rail car bearings and/or wheels, in accordance with an embodiment of the present invention. This system includes a sensor 92, a first comparator 94, a counter 96 and a second comparator 98. Signal 100 of the sensor is an input to the first comparator 94. The first comparator 94 compares the sensor signal 100 to a decision threshold 102. As discussed earlier, those skilled in the art may choose the decision threshold 102 readily, by using basic techniques of signal detection theory and the threshold can then be adjusted dynamically by an adaptive algorithm. A counter 96 increments the count when the input signal samples are above that threshold and reports the result to a second comparator 98. The second comparator 98 then compares the counter result to a decision threshold 104 and then issues a decision concerning the presence or absence of a hot rail car surface. The function performed by the counter 96 may be any one of several. In one embodiment, the counter function comprises counting of the number of incidents of the sensor signal exceeding the threshold. In another embodiment, the counter function comprises measuring a run-length persistence that determines whether the number of counts of sequential sensor signal samples exceeds the threshold. In yet another embodiment, the counter function comprises counting the final state of a counter, initially set to a particular value and incremented when the sampled sensor signal exceeds a threshold and decremented when the sampled signal does not exceed the threshold.

Figure 5:
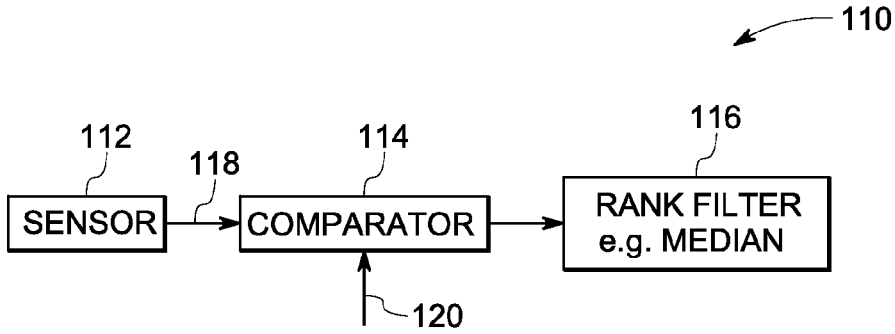
FIG. 5 is a diagrammatic representation of a comparator-filter system for detecting hot rail car bearings and wheels, in accordance with an embodiment of the present invention.

FIG. 5 is a comparator-filter embodiment 110 of processing circuitry for detecting hot rail car bearings and/or wheels. This embodiment includes a sensor 112, a comparator 114 and a rank filter 116. The comparator 114 compares sensor signal 118 to a threshold. The output of the comparator 114 is then input to the rank filter 116. In one embodiment rank filter 116 can be a median filter. For example, if the filter receives binary signals (represented as values such as 1 or 0), a median filter will effectively determine whether more of one value or the other is received (by finding the middle point value. However, other ranks may be used as well. The rank filter 116 then filters the comparator output and provides a noise free output. In other words, the rank filter 116 performs the functionality of counter 96 and second comparator 98 of FIG. 4.

Figure 6:
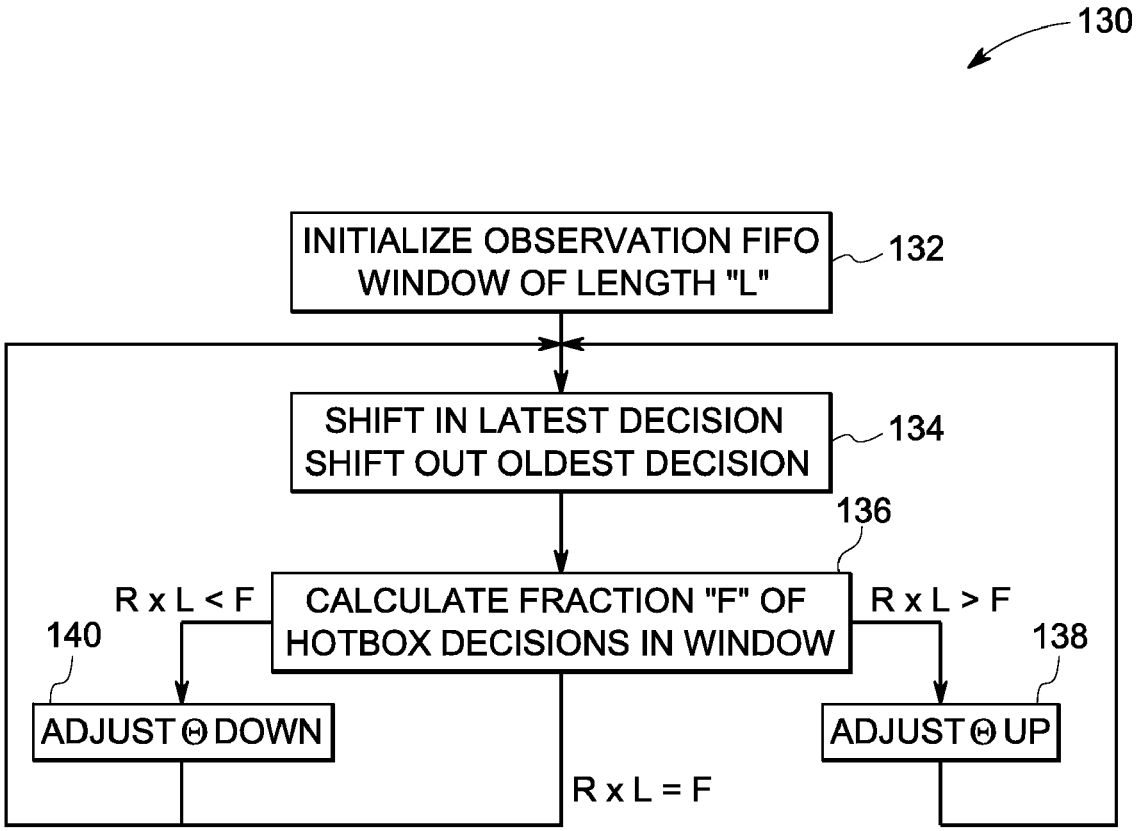
FIG. 6 represents a decision threshold adjustment algorithm in accordance with an embodiment of the present invention.

In both embodiments 90 and 110 discussed above, the decision threshold may be fixed, or can be adjusted dynamically. FIG. 6 represents the decision threshold adaptive algorithm 130. A first in first out (FIFO) window of length L is initialized at start in step 132. The FIFO window of length L contains the decisions regarding the differentiation of abnormally hot rail car bearings and/or wheels and normally hot rail car surfaces. In step 134, old values of threshold are removed and new values are updated. Decision regarding the differentiation of abnormally hot rail car surfaces and normally hot rail car surfaces is taken in step 136. If R×L is less than F, then the decision threshold, Θ, is increased in step 138, where R is a rate at which the alarm for hot bearing detection is generated and F is a number of decisions for an abnormally hot rail car surface within the FIFO window. If R×L is greater than F, the decision threshold is decreased in step 140. If it is equal, the decision threshold is maintained constant.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for detecting a moving hot bearing or wheel of a rail car comprising:

a first comparator configured to receive input signals representative of radiation emitted by the moving hot rail car bearing or wheel, and to compare the input signals to a threshold value;

a counter configured to count incidents of the input signals exceeding the threshold value; and a second comparator configured to compare a number of incidents of the input signals exceeding the threshold value to a count threshold as an indication of detection of a hot rail car bearing or wheel.

2. The system of claim 1, wherein the first comparator, the counter and the second comparator are implemented as appropriate programming in digital processing circuitry.

3. The system of claim 1, wherein the first comparator, the counter and the second counter are implemented as analog circuits.

4. The system of claim 1, wherein the counter is configured to count successive incidents of the input signals exceeding the threshold value.

5. The system of claim 4, wherein the counter is configured to decrement a count when sampled input signals do not exceed the threshold value.

6. The system of claim 1, comprising sensors disposed adjacent to a rail for detecting the radiation emitted by the moving hot rail bearing or wheel.

7. The system of claim 6 wherein, the sensor for sensing the infrared radiation comprises a pyroelectric infrared sensor.

8. The system of claim 1, comprising communications circuitry configured to communicate an alarm signal to a remote monitor indicating that a bearing or wheel temperature is in excess of a desired value based upon the output.

9. The system of claim 1, wherein the threshold value is set by an adaptive algorithm.

10. A system for detecting a moving hot bearing or wheel of a rail car comprising:

sensors disposed adjacent to a rail for detecting the radiation emitted by the moving hot rail bearing or wheel;

a first comparator configured to receive input signals from the sensors representative of radiation emitted by the moving hot rail car bearing or wheel, and to compare the input signals to a threshold value;

a counter configured to count incidents of the input signals exceeding the threshold value; and a second comparator configured to compare a number of incidents of the input signals exceeding the threshold value to a count threshold as an indication of detection of a hot rail car bearing or wheel.

11. The system of claim 10, wherein the first comparator, the counter and the second comparator are implemented as appropriate programming in digital processing circuitry.

12. The system of claim 10, wherein the first comparator, the counter and the second counter are implemented as analog circuits.

13. The system of claim 10, wherein the counter is configured to count successive incidents of the input signals exceeding the threshold value.

14. The system of claim 13, wherein the counter is configured to decrement a count when sampled input signals do not exceed the threshold value.

15. The system of claim 10, comprising communications circuitry configured to communicate an alarm signal to a remote monitor indicating that a bearing or wheel temperature is in excess of a desired value based upon the output.

16. The system of claim 10, wherein the threshold value is set by an adaptive algorithm.

* * * * *